United States Patent [19]

Yamamura et al.

[11] Patent Number: 4,885,102

[45] Date of Patent: Dec. 5, 1989

[54] CLOTH-SOFTENING LIQUID COMPOSITION CONTAINING QUATERNARY AMMONIUM COMPOUND AND A POLYETHER DERIVATIVE OR CATIONIC SURFACTANT POLYMER

[75] Inventors: Masaaki Yamamura; Junichi Inokoshi; Tetuo Ito; Kazumitsu Furuta, all of Utsunomiya; Kazuo Shimizu, Ichikai, all of Japan

[73] Assignee: Kao Corporation, Tokyo, Japan

[21] Appl. No.: 211,352

[22] Filed: Jun. 24, 1988

[30] Foreign Application Priority Data

Jul. 17, 1987 [JP] Japan ..... 62-178549
Aug. 26, 1987 [JP] Japan ..... 62-212221

[51] Int. Cl.[4] ..... C11D 1/62; D06M 13/46; D06M 15/21

[52] U.S. Cl. ..... 252/8.8; 8/115.6; 252/8.6; 252/8.75; 252/8.9

[58] Field of Search ..... 252/8.8, 8.9

[56] References Cited

U.S. PATENT DOCUMENTS

| | | | |
|---|---|---|---|
| 3,838,057 | 9/1974 | Barnes et al. | 252/117 |
| 4,075,110 | 2/1978 | Duffin | 252/8.8 |
| 4,265,772 | 5/1981 | Jones | 252/8.6 |
| 4,272,386 | 6/1981 | Draper et al. | 252/8.6 |
| 4,338,204 | 7/1982 | Spadini et al. | 252/8.75 |
| 4,476,030 | 10/1984 | May et al. | 252/8.8 |
| 4,767,547 | 8/1988 | Straathof et al. | 252/8.8 |

*Primary Examiner*—A. Lionel Clingman
*Attorney, Agent, or Firm*—Flynn, Thiel, Boutell & Tanis

[57] ABSTRACT

A cloth-softening liquid composition has a high concentration and comprises (a) a quaternary ammonium and (b-I) a polyether or a derivative thereof or (b-II) a polymer or copolymer of a cationic surfactant monomer(s), said polyether having a molecular weight of 5,000 to 200,000, being a polyoxyalkylene adduct to a compound having at least five active hydrogen atoms, the oxyalkylene units containing oxyethylene units so that the polyether may contain 50 or more percent by weight of them, said cationic surfactant monomer having a straight or branched alkyl or alkenyl having 8 to 24 carbon atoms, the alkyl or alkenyl optionally having a substituent(s).

9 Claims, No Drawings

CLOTH-SOFTENING LIQUID COMPOSITION CONTAINING QUATERNARY AMMONIUM COMPOUND AND A POLYETHER DERIVATIVE OR CATIONIC SURFACTANT POLYMER

The present invention relates to a softener. Particularly, it relates to a concentrated softener for clothes which can impart excellent softness and antistatic properties to various fibers and is reduced in viscosity increase with time.

Clothes tend to be stiffened and exhibit uncomfortable hand as they are repeatedly worn and washed, because the treatment applied to the fiber is washed out and the fiber itself is degraded. Recently, therefore, a softener which can impart softness and antistatic properties to fibers is frequently used in many homes.

Most commercially available household softeners contain a cationic surfactant having one or two long-chain alkyl groups in its molecule, particularly di(hardened tallow alkyl)dimethylammonium salt as a main component.

A softener base comprising such a quaternary ammonium salt as a main component is only slightly soluble in water, so that it is generally used as a softener in the form of a 3 to 5% by weight aqueous dispersion or emulsion. As the clothes to be treated with a softener have increased, a concentrated softener for clothes comprising a high-concentration aqueous dispersion has been strongly demanded in order to reduce the distribution and packaging costs and the storage space of stock in the home or shop.

However, an aqueous dispersion softener as described above exhibits a remarkably increased viscosity, thus causing various troubles in handling, when the concentration thereof exceeds 5% by weight.

The known processes according to the prior art for preparing a high-concentration softener include:

(1) a process of adding a water-soluble cationic surfactant, (2) a process of adding an adduct of a higher alcohol or an alkylphenol with ethylene oxide, (3) a process of adding urea or ethylene glycol, and (4) a process of adding a water-soluble salt.

However, the processes (1) to (3) are problematic in that the degree of concentration is insufficient and that the obtained softener causes viscosity increase with time, thus being not effective sufficiently.

According to the process (4), the viscosity increase of the softener with time can be hardly controlled, though the initial viscosity thereof is perceptibly lowered. Further, the softener tends to cause phase separation when it contains a large amount of a salt. Thus, no satisfactory concentrated softener for clothes has been obtained as yet.

SUMMARY OF THE INVENTION

Under these circumstances, the inventors of the present invention have eagerly studied with the purpose of overcoming the above problems and have found that a high-concentration dispersion of a quaternary ammonium salt which is improved in initial characteristics and can remarkably control viscosity increase with time can be prepared by dispersing said quaternary ammonium salt in the presence of a specified polyoxyalkylene adduct or a polymer of a cationic surfactant monomer.

A cloth-softening liquid composition of the invention has a high concentration and comprises (a) a quaternary ammonium salt and (b-I) a polyether or a derivative thereof or (b-II) a polymer or copolymer of a cationic surfactant monomer(s), said polyether having a molecular weight of 5,000 to 200,000, being a polyoxyalkylene adduct to a compound having at least five active hydrogen atoms, the oxyalkylene units containing oxyethylene units so that the polyether may contain 50 or more percent by weight of them, said cationic surfactant monomer having a straight or branched alkyl or alkenyl having 8 to 24 carbon atoms, the alkyl or alkenyl optionally having a substituent(s).

It is preferable that the composition comprises 7 to 30 wt. % of the (a) and 0.2 to 10 wt. % of the component (b), the (b-I) or the (b-II), the balance being water.

The invention includes two embodiments, a composition comprising (a) and (b-I) and another comprising (a) and (b-II).

Namely, the present invention provides a concentrated softener for clothes characterized by containing (a) a quaternary ammonium salt, and (b-I) one or more compounds selected from among polyethers which are obtained by the addition of a compound having at least five active hydrogen atoms with an alkylene oxide component containing ethylene oxide as an essential component and which has a molecular weight of 5,000 to 200,000 and the total weight of the polyoxyethylene chain segment of at least 50% of the total weight, and derivatives thereof, as active ingredients.

Namely, the present invention provides a concentrated softener for clothes characterized by containing.

(a) a quaternary ammonium salt, and (b-II) a polymer comprising a long-chain alkyl or alkenyl cationic monomer having a straight-chain or branched alkyl or alkenyl group having 8 to 24 carbon atoms and/or a long-chain alkyl or alkenyl cationic monomer having a substituted, straight-chain or branched alkyl or alkenyl group having 8 to 24 carbon atoms (hereinafter abbreviated to "cationic surfactant monomer") as an essential component, as active ingredients.

The invention will be below illustrated in reference to the components (a), (b-I) and (b-II).

The quaternary ammonium salt (a) to be used as a softener base in the present invention includes the following salts, which may be used as a mixture of two or more of them:

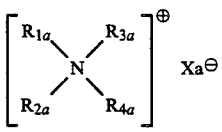

(Ia)

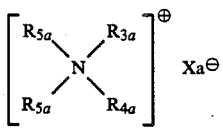

(IIa)

-continued (IIIa)

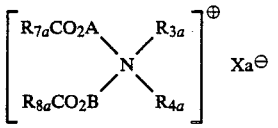

(IVa)

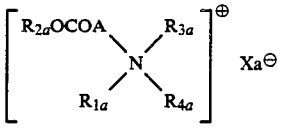

(Va)

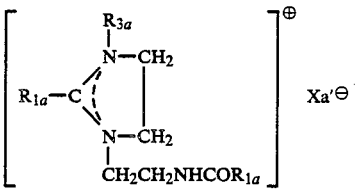

(VIa)

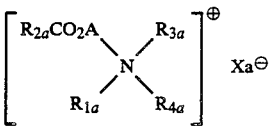

wherein $R_{1a}$: a $C_{8\sim22}$ saturated or unsaturated, straight-chain or branched alkyl or hydroxyalkyl group, $R_{2a}$: a $C_{8\sim24}$ saturated or unsaturated, straight-chain or branched alkyl or hydroxyalkyl group, $R_{3a}$, $R_{4a}$, $R_{6a}$: each a $C_{1\sim3}$ alkyl or hydroxyalkyl group or a group of $$-(CH_2-\underset{\underset{Y_a}{|}}{CH}-O)_n-H$$

wherein n is 1 to 10 and $Y_a$ is a hydrogen atom or a methyl group, $R_{5a}$: a $C_{24\sim36}$ saturated or unsaturated branched alkyl or hydroxyalkyl group, $R_{7a}$, $R_{8a}$: each a $C_{7\sim21}$ saturated or unsaturated, straight-chain or branched alkyl or hydroxyalkyl group, A, B: each a $C_{1\sim3}$ alkylene group, and $X_a$: a $CH_3SO_4$, $C_2H_5SO_4$, $C_nH_{2n+1}COO$ (wherein n is 0 to 17), $C_nH_{2n+1}OPO_3$ (wherein n is 8 to 18), $HOCH_2COO$, or

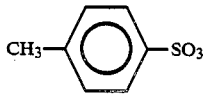

group or a halogen atom.

The compound having at least five active hydrogen atoms which is a starting material for the preparation of the polyoxyalkylene adduct to be used in the present invention as the component (b-I) includes polyhydric alcohols such as sorbitol, sucrose, polyglycerin, polyvinyl alcohol and partially saponified polyvinyl acetate; polyhydric phenols such as phenol resins and alkylphenol-formalin condensates; polyamines such as diethylenetriamine, triethylenetetramine, tetraethylenepentamine, pentaethylenehexamine and polyethyleneimine. Further, partial amide derivatives and N-alkyl-substituted derivatives of these polyamines can be used, as far as they have at least five residual active hydrogen atoms.

The polyether which is a specified polyoxyalkylene adduct as defined above can be easily prepared by carrying out the addition of a compound having at least five active hydrogen atoms with an alkylene oxide component containing ethylene oxide as an essential component according to any conventional method. Among the polyethers thus prepared, adducts thereof containing ethylene oxide homopolymer segment and adducts thereof containing ethylene oxide/propylene oxide block or partially block copolymer segment are particularly preferred. Although the addition of any of the two oxides may be first carried out, a more excellent concentrated softener for clothes can be obtained by carrying out the addition of propylene oxide (hereinafter abbreviated to "PO") and that of ethylene oxide (hereinafter abbreviated to "EO") successively.

The molecular weight of the polyether or derivative thereof is 5,000 to 200,000, preferably 10,000 to 100,000. Further, the total weight of the EO chain segment is at least 50%, preferably at least 80%, of the total molecular weight.

The polyether derivatives according to the present invention include sulfates, phosphates, alkylcarboxylates and fatty acid esters of the terminal hydroxyl group of the polyether and cations obtained by partially cationizing the nitrogen atom of the polyether, among which fatty acid esters and cations are particularly preferred.

In the preparation of the above fatty acid ester of the polyether, it is preferred to use a fatty acid having 7 to 23 carbon atoms, although the number of double bonds and the presence of branching do not have a significant influence upon the performance.

The above cations include those obtained by cationizing the polyether with dialkylsulfates or alkyl halides and those obtained by neutralizing the polyether with acetic acid or an alkylbenzenesulfonic acid.

In the concentrated softener according to the present invention, it is presumed that the quaternary ammonium salt particles present in water may be sterically protected by the component (b-I) owing to its remarkably high bulkiness and high molecular weight, so that the aggregation of the particles may be inhibited to thereby control the viscosity increase.

The polymer (b-II) comprising a cationic surfactant monomer as an essential component to be used in the present invention can be prepared by any conventional method. For example, it can be obtained by polymerizing a mixture comprising a cationic surfactant monomer and other vinyl monomer(s) in a solvent in the presence of a radical polymerization initiator. Preferred examples of the solvent include water; alcohols such as ethanol, isopropanol and butanol; polyols such as ethylene glycol and propylene glycol; and ketones such as methyl ethyl ketone. The radical polymerization initiator is preferably selected from among those soluble in the solvent used. For example, when water or a water-containing organic solvent is used, the initiator is selected from among ammonium persulfate, potassium persulfate, 2,2'-azobis(2-amidinopropane) dihydrochloride, 4,4'-azobis(4-cyanovaleric acid) and the like. The polymerization temperature is generally set at the decomposition point of the radical polymerization initiator used, though it may be set at a lower temperature, when a redox initiator is used.

Preferred examples of the cationic surfactant monomer to be used in the present invention include those represented by the following formula:

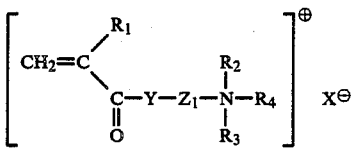

(1)

wherein $R_1$ stands for a hydrogen atom or a methyl group; $R_2$ stands for a straight-chain or branched alkyl or alkenyl group having 8 to 24 carbon atoms or a substituted, straight-chain or branched alkyl or alkenyl group having 8 to 24 carbon atoms; $R_3$ and $R_4$ each stand for a hydrogen atom or a lower alkyl, $C_{2\sim4}$ hydroxyalkyl or polyoxyalkylene ($\overline{P}=1$ to 3) group; Y stands for an oxygen atom or an —NH—group; $Z_1$ is a hydroxyalkylene group having 2 to 4 carbon atoms and X stands for a halogen atom or an acid residue.

The polymer (b-II) is preferably a binary or higher copolymer comprising a cationic surfactant monomer as described above and vinyl monomer(s). The copolymer preferably contains 3 to 50% by weight, still preferably 5 to 30% by weight of such a cationic surfactant monomer.

The vinyl monomer to be copolymerized is not particularly limited and includes the following monomers:

hydrophobic monomer alkyl (meth)acrylates having a $C_{1\sim24}$ hydrocarbyl group and styrene and α-methylstyrene which may be substituted on the benzene ring, hydrophilic monomer acrylamide, methacrylamide, N-vinyl-2-pyrrolidone, 2-hydroxyethyl methacrylate, 2-hydroxyethyl acrylate, polyethylene glycol monomethacrylate, methoxypolyethylene glycol methacrylate and acetone acrylamide, and cationic monomer quaternary ammonium salts represented by the general formula:

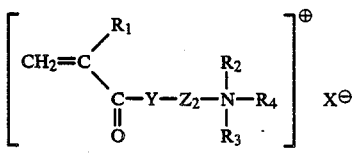

(2)

wherein $R_1$ stands for a hydrogen atom or a methyl group; $R_2$, $R_3$ and $R_4$ each stand for a hydrogen atom, a lower alkyl, $C_{2\sim4}$ hydroxyalkyl or polyoxyalkylene ($\overline{P}=1$ to 3) group; Y stands for an oxygen atom or an —NH— group; $Z_2$ stands for an alkylene or hydroxyalkylene group having 2 to 4 carbon atoms and X stands for a halogen atom or an acid residue.

In the softener according to the present invention, its viscosity increase is controlled presumably because the long-chain alkyl or alkenyl group of the cationic surfactant monomer constituting the polymer (b-II) strongly adsorb the softening component to give an electric charge, while the polymer (b-II) having a high molecular weight, as a whole, sterically protect the quaternary ammonium salt in water, thus inhibiting the aggregation of the particles.

According to the present invention, the content of the component (a) in the concentrated softener is 7 to 30% by weight, preferably 10 to 20% by weight, while the content of the component (b) therein is 0.2 to 10% by weight, preferably 0.5 to 5% by weight.

If the content of the component (a) is less than 7% by weight, the advantage due to the concentration will hardly be obtained as compared with the softener of an ordinary concentration according to the prior art, while if the content exceeds 30% by weight, the resulting softener will have such a high viscosity as to cause various troubles in handling.

If the content of the component (b) is less than 0.2% by weight, the resulting softener will exhibit too high an initial viscosity and the viscosity increase thereof with time cannot be controlled sufficiently. On the contrary, the use thereof in such an amount as to give a content exceeding 10% by weight will be economically disadvantageous.

The concentrated softener for clothes according to the present invention may contain a perfume, dyestuff, nonionic surfactant, silicone and/or antimicrobial agent, which are ordinarily used in a softener for clothes, or a solvent such as isopropyl alcohol, ethylene glycol or propylene glycol or a water-soluble salt such as common salt, ammonium chloride or calcium chloride.

Although the compounding procedure of the components (a) and (b) and other components is not particularly limited, the compounding thereof is generally carried out by throwing the component (a) into an aqueous solution or dispersion containing a predetermined amount of the component (b) at a temperature selected in the range of room temperature to 70° C. depending upon the softening point of the component (a) used, followed by stirring. Other components such as nonionic surfactant or salt may be added either together with the component (b) or after the compounding of the components (a) and (b). The compounding procedure which is most effective in lowering the initial viscosity of the concentrated softener is a process comprising adding the component (b) and other components such as salt to a concentrated aqueous dispersion of the component (a), while the compounding procedure which is simplest in terms of equipment is a process which comprises preliminarily mixing the components (a) and (b) and part of other components and dispersing the obtained mixture in water.

In any of these procedures, the compounding may be carried out with a mixer fitted with blades or a line mixer or by high-pressure injection. Particularly, when the compounding is carried out first with a kneader or a mixer fitted with blades and then with a high-shear mixer, an excellent dispersion can be attained.

The concentrated softener for clothes according to the present invention which contains the components (a) and (b) as active ingredients exhibits its effect in an amount which is nearly inversely proportional to the active ingredients as compared with a softener of a conventional concentration. Therefore, the concentrated softener for clothes brings about great saving of energy and resources in various steps including transportation, packaging and storage of stock.

EXAMPLES

The present invention will be described in more detail by referring to the following Examples, though it is not limited to them.

The components (a) used in the Examples are listed in Table 1 with reference to the above shown formulae; the components (b-I), in Table 2; and the components (b-II), in Table 3.

One example of the compound (b-II) is shown below.

150 parts of a solution of 5.4 parts of 2-hydroxy-3-methacryloyloxypropyldimethylstearylammonium chloride (corresponding to a compound of the formula (1) wherein $R_1$ is a methyl group; $R_2$ is a stearyl group; $R_3$ and $R_4$ are each a methyl group; Y is an oxygen atom; Z is 2-hydroxypropylene group and X is a halogen atom), 37 parts of β-methacryloyloxyethyldimethylethylammonium ethosulfate, 12.5 parts of styrene, 10.3 parts of acrylamide and 1.0 part of 2,2'-azobisisobutyronitrile in isopropanol was dropwise added to 100 parts of isopropanol under reflux over a period of 2 hours. After the completion of the dropwise addition, the reaction mixture was heated under reflux for 3 hours and diluted with 200 ml of water. The resulting mixture was distilled to remove the isopropanol and subjected to concentration adjustment to obtain an aqueous solution having a solid content of 20.0%.

The compositions obtained in Examples and Comparative Examples are examined in the below shown manners.

(1) Physical Properties and Stability

The concentrated softener for clothes was stored at a temperature of −10° C., room temperature or 50° C. for 20 days to evaluate its appearance and fluidity. Results are shown in Tables 4 and 5. All of the concentrated softeners according to the present invention were excellent in these respects and caused little changes with time.

(2) Softening Power

Commercially available cotton towel and knit underwear, acrylic fiber, polyester fiber and blended fiber were washed five times with a commercially available detergent (Zab mfd. by Kao Corporation; registered trade mark) and got rid of the detergent adhering thereto. They were treated with a 0.1% by weight aqueous solution (in terms of active ingredients, 3.5° DH hard water) of the concentrated softener according to the present invention at 25° C. with a bath ratio of 1/30 under stirring for one minute, air-dried in a room and allowed to stand in a thermo-hygrostated room of 25° C. and 65% RH for 24 hours. The resulting clothes were compared with those treated with a softener of a conventional concentration. The concentrated softeners of the present invention were confirmed to have a sufficiently high softening power.

Test on the Composition of (a) and (b-I)

Examples 1 to 39 and Comparative Examples 1 to 8 are listed in Table 4 together with their test results.

Test on the Composition of (a) and (b-II)

Examples 40 to 64 and Comparative Examples 9 to 16 are listed in Table 5 together with their test results.

The following footnotes apply to Table 4 and Table 5.

(1) % by weight
(2) cps, the mark "x" means failure in measurement
(3) polyoxyethylene (15 mol) lauryl ether
(4) ethylene glycol

TABLE 1

| Symbol | Formula | Composition of component (a) Structure |
|---|---|---|
| a-1 | $I_a$ | $R_{1a} = R_{2a} = C_{18}$ alkyl, $R_{3a} = R_{4a}$ = methyl, $X_a$ = Cl |
| a-2 | $I_a$ | $R_{1a} = R_{2a} = C_{18}$ alkyl, $R_{3a}$ = methyl, $R_{4a} = C_2H_5$, $X_a = C_2H_5SO_4$ |
| a-3 | $I_a$ | $R_{1a} = C_{12}$ alkyl, $R_{2a} = C_{18}$ alkyl, $R_{3a} = R_{4a}$ = methyl, $X_a$ = Cl |
| a-4 | $II_a$ | $R_{5a} = C_{28}$ branched alkyl, $R_{3a} = R_{4a} = R_{6a}$ = methyl, $X_a$ = Cl |
| a-5 | $III_a$ | $R_{7a} = R_{8a} = C_{17}$ alkyl, $R_{3a} = C_2H_5OH$, $R_{4a} = C_2H_5$, A = B = $CH_2CH_2$, $X_a = C_2H_5SO_4$ |
| a-6 | $IV_a$ | $R_{1a} = C_{10}$ alkyl, $R_{2a} = C_{18}$ alkyl, $R_{3a} = R_{4a}$ = methyl, $X_a$ = Br, A = $CH_2$ |
| a-7 | $V_a$ | $R_{1a} = C_{17}$ unsaturated alkyl, $R_{3a} = C_2H_5$, $X_a = C_2H_5SO_4$ |
| a-8 | $VI_a$ | $R_{1a} = C_{10}$ alkyl, $R_{2a} = C_{18}$ alkyl, $R_{3a} = R_{4a}$ = methyl, A = $CH_2CH_2$, $X_2$ = Cl |

TABLE 2

| Symbol | Starting material | Component (b-I) (number of active hydrogen atoms) | Alkylene oxide(1) (ratio)(2) | | MW | Modification |
|---|---|---|---|---|---|---|
| b-1 | glycerin | (3) | PO/EO | (1/9) | 9,500 | — |
| b-2 | ethylenediamine | (4) | PO/EO | (3/7) | 16,000 | — |
| b-3 | diethanolamine | (3) | PO/EO | (1/9) | 8,800 | — |
| b-4 | sorbitol | (6) | PO/EO | (2/8) | 12,000 | — |
| b-5 | sorbitol | (6) | EO | | 14,000 | — |
| b-6 | phenol resin (10-nuclear) | (10) | EO | | 20,000 | — |
| b-7 | triethylenetetramine | (6) | PO/EO | (2/8) | 13,000 | oleic acid-modified (1/6)(3) |
| b-8 | " | (6) | PO/EO | (2/8) | 13,000 | diethylsulfate (3/6)(4) |
| b-9 | " | (6) | PO/EO | (2/8) | 13,000 | |
| b-10 | tetraethylenepentamine | (7) | PO/EO | (2/8) | 16,000 | |
| b-11 | " | (7) | EO | | 15,000 | |
| b-12 | polyethyleneimine (MW1600) | (38) | PO/EO | (2/8) | 70,000 | |
| b-13 | polyethyleneimine | (38) | EO | | 100,000 | |

TABLE 2-continued

| Symbol | Starting material | Component (b-I) (number of active hydrogen atoms) | Alkylene oxide[1] (ratio)[2] | MW | Modification |
|---|---|---|---|---|---|
| | ($\overline{MW}$1600) | | | | |
| b-14 | oleic amide of tetraethylene-pentamine | (6) | EO | 8,000 | |

[1]PO: propylene oxide, EO: ethylene oxide
[2]weight ratio
[3]degree of esterification based on the terminal hydroxyl group
[4]degree of cationization per nitrogen atom

TABLE 3

| Symbol | Composition of component (b-II): Cationic surfactant monomer general formula (1) | | Hydrophobic monomer | | Hydrophilic monomer | | Cationic monomer general formula (2) | |
|---|---|---|---|---|---|---|---|---|
| b-1 | $R_1$ = methyl<br>$R_2$ = stearyl<br>$R_3$, $R_4$ = methyl<br>Y = oxygen<br>$Z_1$ = 2-hydroxypropylene<br>X = Cl | 5.4 parts | styrene | 12.5 parts | acrylamide | 10.3 parts | $R_1$ = methyl<br>$R_3$, $R_4$ = methyl<br>$R_5$ = ethyl<br>Y = oxygen<br>$Z_2$ = ethylene<br>X = $OSO_3C_2H_5$ | 37 parts |
| b-2 | $R_1$ = methyl<br>$R_2$ = stearyl<br>$R_3$, $R_4$ = methyl<br>Y = oxygen<br>$Z_1$ = 2-hydroxypropylene<br>X = Cl | 8.0 parts | 2-ethylhexyl acrylate | 10.5 parts | acrylamide | 10.5 parts | $R_1$ = methyl<br>$R_3$, $R_4$ = methyl<br>$R_5$ = ethyl<br>Y = oxygen<br>$Z_2$ = 2-hydroxypropylene<br>X = $OSO_3C_2H_5$ | 37 parts |
| b-3 | $R_1$ = methyl<br>$R_2$ = lauryl<br>$R_3$, $R_4$ = methyl<br>Y = oxygen<br>$Z_1$ = 2-hydroxypropylene<br>X = Cl | 15.0 parts | 2-ethylhexyl acrylate | 10.5 parts | polyethylene glycol monomethacrylate | 10.5 parts | | |
| b-4 | $R_1$ = hydrogen<br>$R_2$ = stearyl<br>$R_3$, $R_4$ = methyl<br>Y = oxygen<br>$Z_1$ = 2-hydroxypropylene<br>X = Cl | 8.0 parts | styrene | 10.5 parts | 2-hydroxyethyl methacrylate | 10.5 parts | $R_1$ = methyl<br>$R_3$, $R_4$ = methyl<br>$R_5$ = ethyl<br>Y = oxygen<br>$Z_2$ = ethylene<br>X = $OSO_3C_2H_5$ | 37 parts |
| b-5 | $R_1$ = methyl<br>$R_2$ = stearyl<br>$R_3$, $R_4$ = methyl<br>Y = oxygen<br>$Z_1$ = 2-hydroxypropylene<br>X = Cl | 24.5 parts | styrene | 2.5 parts | acrylamide | 10.5 parts | $R_1$ = methyl<br>$R_3$, $R_4$ = methyl<br>$R_5$ = ethyl<br>Y = oxygen<br>$Z_2$ = ethylene<br>X = $OSO_3C_2H_5$ | 17 parts |
| b-6 | | | styrene | 12.5 parts | acrylamide | 10.3 parts | $R_1$ = methyl<br>$R_3$, $R_4$ = methyl<br>$R_5$ = ethyl<br>Y = oxygen<br>$Z_2$ = ethylene<br>X = $OSO_3C_2H_5$ | 37 parts |
| b-7 | | | styrene | 15.5 parts | acrylamide | 15.3 parts | $R_1$ = methyl<br>$R_3$, $R_4$ = methyl<br>$R_5$ = ethyl<br>Y = oxygen<br>$Z_2$ = 2-hydroxypropylene<br>X = $OSO_3C_2H_5$ | 37 parts |

TABLE 4

| No. | | Composition of the softener: component (a) compound | component (a) amt.[1] | component (b-I) polymer | component (b-I) amt.[1] | other component (1) compound | other component (1) amt.[1] | other component (2) compound | other component (2) amt.[1] | Initial state and stability after 20 days: initial properties viscosity[2] | initial properties appearance | stability after 20 days: −10° C. | room temp. | 50° C. |
|---|---|---|---|---|---|---|---|---|---|---|---|---|---|---|
| Comp. Examples | 1 | a-1 | 12 | | | | | | | x | gelling | | | |
| | 2 | a-1 | 12 | b-1 | 3 | | | | | x | gelling | | | |
| | 3 | a-1 | 15 | b-1 | 5 | $CaCl_2$ | 0.2 | | | x | gelling | | | |
| | 4 | a-1 | 15 | b-1 | 5 | $CaCl_2$ | 0.5 | | | 340 | good | separation | gelling | separation |
| | 5 | a-1 | 15 | b-2 | 5 | $CaCl_2$ | 0.2 | c-1[3] | 1 | x | gelling | | | |
| | 6 | a-3 | 15 | b-2 | 5 | $CaCl_2$ | 0.2 | c-1[3] | 1 | x | gelling | | | |
| | 7 | a-5 | 12 | b-3 | 3 | $CaCl_2$ | 0.2 | | | 580 | good | gelling | gelling | gelling |
| | 8 | a-5 | 15 | b-3 | 5 | $CaCl_2$ | 0.2 | | | x | gelling | | | |
| Examples | 1 | a-1 | 15 | b-4 | 1 | $CaCl_2$ | 0.2 | | | 260 | good | good | good | good |
| | 2 | a-1 | 15 | b-4 | 3 | | | | | 450 | good | good | good | good |

TABLE 4-continued

| | No. | Composition of the softener: component (a) compound | component (a) amt.[1] | component (b-I) polymer | component (b-I) amt.[1] | other component (1) compound | other component (1) amt.[1] | other component (2) compound | other component (2) amt.[1] | Initial state and stability after 20 days: initial properties viscosity[2] | initial properties appearance | stability after 20 days −10° C. | stability after 20 days room temp. | stability after 20 days 50° C. |
|---|---|---|---|---|---|---|---|---|---|---|---|---|---|---|
| | 3 | a-1 | 15 | b-4 | 5 | $CaCl_2$ | 0.2 | | | 160 | good | good | good | good |
| | 4 | a-1 | 15 | b-4 | 3 | $CaCl_2$ | 0.1 | c-2[4] | 5 | 240 | good | good | good | good |
| | 5 | a-1 | 15 | b-4 | 3 | $CaCl_2$ | 0.2 | c-1[3] | 1 | 130 | good | good | good | good |
| | 6 | a-1 | 15 | b-4 | 3 | NaCl | 0.2 | | | 140 | good | good | good | good |
| | 7 | a-1 | 15 | b-5 | 3 | | | | | 240 | good | good | good | good |
| | 8 | a-1 | 15 | b-5 | 3 | $CaCl_2$ | 0.2 | | | 180 | good | good | good | good |
| | 9 | a-1 | 15 | b-6 | 3 | $CaCl_2$ | 0.1 | | | 260 | good | good | good | good |
| | 10 | a-1 | 15 | b-7 | 3 | | | | | 340 | good | good | good | good |
| | 11 | a-1 | 15 | b-8 | 3 | $CaCl_2$ | 0.2 | | | 130 | good | good | good | good |
| | 12 | a-1 | 15 | b-9 | 3 | $CaCl_2$ | 0.2 | | | 280 | good | good | good | good |
| | 13 | a-1 | 15 | b-10 | 3 | | | | | 380 | good | good | good | good |
| | 14 | a-1 | 15 | b-10 | 3 | $CaCl_2$ | 0.2 | | | 140 | good | good | good | good |
| | 15 | a-1 | 15 | b-10 | 3 | NaCl | 0.2 | | | 180 | good | good | good | good |
| | 16 | a-1 | 15 | b-11 | 3 | $CaCl_2$ | 0.1 | | | 160 | good | good | good | good |
| | 17 | a-1 | 15 | b-12 | 3 | | | | | 240 | good | good | good | good |
| | 18 | a-1 | 15 | b-13 | 3 | | | | | 230 | good | good | good | good |
| | 19 | a-1 | 15 | b-14 | 3 | $CaCl_2$ | 0.2 | | | 150 | good | good | good | good |
| Examples | 20 | a-2 | 15 | b-4 | 3 | | | | | 380 | good | good | good | good |
| | 21 | a-2 | 15 | b-5 | 3 | | | | | 440 | good | good | good | good |
| | 22 | a-2 | 15 | b-5 | 3 | NaCl | 0.2 | | | 140 | good | good | good | good |
| | 23 | a-2 | 15 | b-10 | 3 | | | | | 240 | good | good | good | good |
| | 24 | a-2 | 15 | b-10 | 3 | $CaCl_2$ | 0.2 | | | 180 | good | good | good | good |
| | 25 | a-3 | 15 | b-6 | 3 | $CaCl_2$ | 0.1 | | | 260 | good | good | good | good |
| | 26 | a-2 | 15 | b-10 | 3 | | | | | 350 | good | good | good | good |
| | 27 | a-2 | 15 | b-10 | 3 | $CaCl_2$ | 0.2 | | | 180 | good | good | good | good |
| | 28 | a-3 | 15 | b-4 | 3 | $CaCl_2$ | 0.2 | | | 170 | good | good | good | good |
| | 29 | a-3 | 15 | b-10 | 3 | | | | | 260 | good | good | good | good |
| | 30 | a-3 | 15 | b-10 | 3 | $CaCl_2$ | 0.2 | | | 140 | good | good | good | good |
| | 31 | a-3 | 15 | b-10 | 3 | NaCl | 0.2 | | | 180 | good | good | good | good |
| | 32 | a-4 | 15 | b-4 | 3 | $CaCl_2$ | 0.1 | | | 160 | good | good | good | good |
| | 33 | a-4 | 15 | b-10 | 3 | | | | | 240 | good | good | good | good |
| | 34 | a-4 | 15 | b-13 | 3 | | | | | 230 | good | good | good | good |
| | 35 | a-5 | 15 | b-4 | 3 | | | | | 190 | good | good | good | good |
| | 36 | a-5 | 15 | b-4 | 3 | $CaCl_2$ | 0.2 | | | 140 | good | good | good | good |
| | 37 | a-6 | 15 | b-10 | 3 | | | | | 230 | good | good | good | good |
| | 38 | a-6 | 15 | b-10 | 3 | $CaCl_2$ | 0.2 | | | 150 | good | good | good | good |
| | 39 | a-7 | 15 | b-4 | 3 | | | | | 380 | good | good | good | good |

TABLE 5

| | No. | Composition of the softener: component (a) compound | component (a) amt.[1] | component(b-II) compound | component(b-II) amt.[1] | other component(1) compound | other component(1) amt.[1] | other component(2) compound | other component(2) amt.[1] | Initial state and stability after 20 days: initial properties viscosity[2] | initial properties appearance | stability after 20 days −10° C. | stability after 20 days room temp. | stability after 20 days 50° C. |
|---|---|---|---|---|---|---|---|---|---|---|---|---|---|---|
| Comp. | 9 | a-1 | 12 | | | | | | | X | gelling | | | |
| Ex- | 10 | a-1 | 12 | b-1 | 3 | | | | | X | gelling | | | |
| amples | 11 | a-1 | 15 | b-6 | 5 | $CaCl_2$ | 0.2 | | | X | gelling | | | |
| | 12 | a-1 | 15 | b-6 | 5 | $CaCl_2$ | 0.5 | | | 380 | good | separation | gelling | separation |
| | 13 | a-1 | 15 | b-7 | 5 | $CaCl_2$ | 0.2 | c-1[3] | 1 | X | gelling | | | |
| | 14 | a-3 | 15 | b-7 | 5 | $CaCl_2$ | 0.2 | c-1[3] | 1 | X | gelling | | | |
| | 15 | a-5 | 12 | b-7 | 3 | $CaCl_2$ | 0.2 | | | 480 | good | gelling | gelling | gelling |
| | 16 | a-5 | 15 | b-7 | 8 | $CaCl_2$ | 0.2 | | | X | gelling | | | |
| Ex- | 40 | a-1 | 15 | b-1 | 1 | $CaCl_2$ | 0.2 | | | 280 | good | good | good | good |
| amples | 41 | a-1 | 15 | b-1 | 3 | | | | | 420 | good | good | good | good |
| | 42 | a-1 | 15 | b-1 | 5 | $CaCl_2$ | 0.2 | | | 170 | good | good | good | good |
| | 43 | a-1 | 15 | b-1 | 3 | $CaCl_2$ | 0.1 | c-2[4] | 5 | 260 | good | good | good | good |
| | 44 | a-1 | 15 | b-1 | 3 | $CaCl_2$ | 0.2 | c-1[3] | 1 | 170 | good | good | good | good |
| | 45 | a-1 | 15 | b-1 | 3 | NaCl | 0.2 | | | 180 | good | good | good | good |
| | 46 | a-1 | 15 | b-2 | 3 | | | | | 260 | good | good | good | good |
| | 47 | a-1 | 15 | b-2 | 3 | $CaCl_2$ | 0.2 | | | 180 | good | good | good | good |
| | 48 | a-1 | 15 | b-3 | 3 | $CaCl_2$ | 0.1 | | | 260 | good | good | good | good |
| | 49 | a-1 | 15 | b-4 | 3 | | | | | 340 | good | good | good | good |
| | 50 | a-1 | 15 | b-5 | 3 | $CaCl_2$ | 0.2 | | | 130 | good | good | good | good |
| Ex- | 51 | a-2 | 15 | b-1 | 3 | | | | | 380 | good | good | good | good |
| amples | 52 | a-2 | 15 | b-2 | 3 | | | | | 440 | good | good | good | good |
| | 53 | a-2 | 15 | b-2 | 3 | NaCl | 0.2 | | | 140 | good | good | good | good |
| | 54 | a-3 | 15 | b-1 | 3 | $CaCl_2$ | 0.2 | | | 170 | good | good | good | good |
| | 55 | a-3 | 15 | b-1 | 3 | $CaCl_2$ | 0.1 | | | 160 | good | good | good | good |
| | 56 | a-3 | 15 | b-2 | 3 | | | | | 240 | good | good | good | good |

TABLE 5-continued

| | Composition of the softener | | | | | | | | Initial state and stability after 20 days | | | | |
|---|---|---|---|---|---|---|---|---|---|---|---|---|---|
| | component (a) | | | | | | | | initial properties | | stability after 20 days | | |
| No. | compound | amt.[1] | component(b-II) compound | amt.[1] | other component(1) compound | amt.[1] | other component(2) compound | amt.[1] | viscosity[2] | appearance | −10° C. | room temp. | 50° C. |
| 57 | a-3 | 15 | b-3 | 3 | | | | | 230 | good | good | good | good |
| 58 | a-4 | 15 | b-1 | 3 | $CaCl_2$ | 0.1 | | | 160 | good | good | good | good |
| 59 | a-5 | 15 | b-1 | 3 | | | | | 190 | good | good | good | good |
| 60 | a-5 | 15 | b-1 | 3 | $CaCl_2$ | 0.2 | | | 140 | good | good | good | good |
| 61 | a-6 | 15 | b-1 | 3 | | | | | 230 | good | good | good | good |
| 62 | a-6 | 15 | b-1 | 3 | $CaCl_2$ | 0.2 | | | 150 | good | good | good | good |
| 63 | a-7 | 15 | b-1 | 3 | | | | | 380 | good | good | good | good |
| 64 | a-8 | 15 | b-1 | 3 | $CaCl_2$ | 0.2 | | | 170 | good | good | good | good |

We claim:

1. A cloth-softening, liquid composition, comprising:

(a) from 7 to 30 wt. % of a quaternary ammonium salt component selected from the group consisting of compounds of the formulas

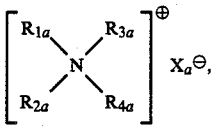

$X_a\ominus$,

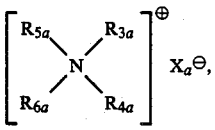

$X_a\ominus$,

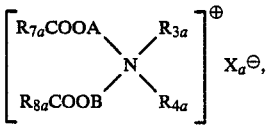

$X_a\ominus$,

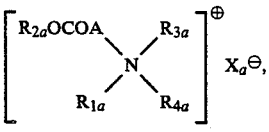

$X_a\ominus$,

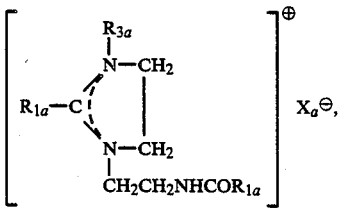

$X_a\ominus$,

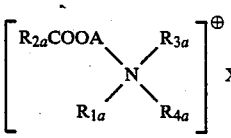

$X_a\ominus$ and mixtures thereof, wherein $R_{1a}$ is $C_8$ to $C_{22}$, saturated or unsaturated, straight-chain or branched, aliphatic hydrocarbon group or hydroxy-substituted aliphatic hydrocarbon group, $R_{2a}$ is $C_8$ to $C_{24}$, saturated or unsaturated, straight-chain or branched, aliphatic hydrocarbon group or hydroxy-substituted aliphatic hydrocarbon group, $R_{3a}$, $R_{4a}$ and $R_{6a}$ each is a $C_1$ to $C_3$ alkyl or hydroxyalkyl group or a group of the formula $$-(CH_2-\underset{\underset{Y_a}{|}}{CH}-O)_n-H$$

wherein n is an integer of 1 to 10 and $Y_a$ is hydrogen or methyl, $R_{5a}$ is a $C_{24}$ to $C_{36}$, saturated or unsaturated, branched aliphatic hydrocarbon group or hydroxy-substituted aliphatic hydrocarbon group, $R_{7a}$ and $R_{8a}$ each is a $C_7$ to $C_{21}$, saturated or unsaturated, straight-chain or branched, aliphatic hydrocarbon group or hydroxy-substituted aliphatic hydrocarbon group, A and B each is a $C_1$ to $C_3$ alkylene group, and $X_a$ is $CH_3SO_4$, $C_2H_5SO_4$, $C_nH_{2n+1}COO$ (wherein n is 0 to 17), $C_{n'}H_{2n'+1}OPO_3$ (wherein n' is 8 to 18), $HOCH_2COO$,

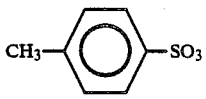

or halogen, (b) from 0.2 to 10 wt. % of (I) a substance selected from the group consisting of (i) polyethers prepared by adducting ethylene oxide alone or both of ethylene oxide and propylene oxide to a compound having at least five active hydrogen atoms and which is selected from the group consisting of polyhydric alcohols, polyhydric phenols and polyamines, said polyether having a molecular weight of from 5,000 to 200,000 and containing at least 50 wt. % of ethylene oxide, based on the total weight of said polyether, (ii) sulfates, phosphates, alkylcarboxylates and fatty acid esters of the terminal hydroxy group of said polyethers, (iii) quaternary ammonium compounds of said polyethers that contain a nitrogen atom, with dialkylsulfates or alkyl halides, and (iv) salts of said polyethers with acetic acid or an alkylbenzene sulfonic acid, or (II) a polymer of a cationic surfactant monomer having the formula

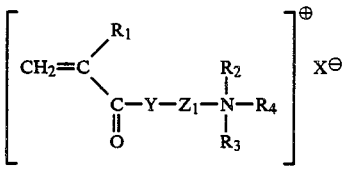

wherein $R_1$ is hydrogen or methyl; $R_2$ is a straight-chain or branched, alkyl or alkenyl having 8 to 24 carbon atoms or a substituted, straight-chain or branched, alkyl or alkenyl having 8 to 24 carbon atoms; $R_3$ and $R_4$ each is hydrogen, lower alkyl, $C_2$ to $C_4$ hydroxyalkyl or polyoxyalkylene ($\overline{P}=1$ to 3); Y is oxygen or —NH—; $Z_1$ is hydroxyalkylene having 2 to 4 carbon atoms and X is halogen or an acid residue, or a copolymer of said cationic surfactant monomer and at least one additional vinyl monomer, and the balance comprises water.

2. A cloth-softening, liquid composition as claimed in claim 1, containing from 10 to 20 wt. % of (a) and from 0.5 to 5 wt. % of (b).

3. A cloth-softening, liquid composition, comprising:

(a) from 7 to 30 wt. % of a quaternary ammonium salt component selected from the group consisting of compounds of the formulas

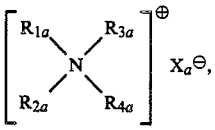

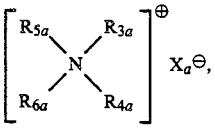

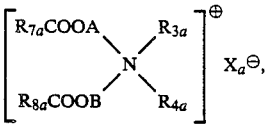

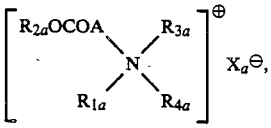

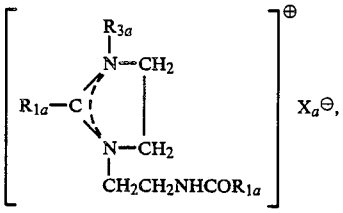

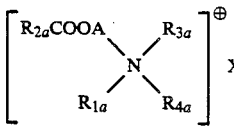

$X_a\ominus$ and mixtures thereof, wherein $R_{1a}$ is $C_8$ to $C_{22}$, saturated or unsaturated, straight-chain or branched, aliphatic hydrocarbon group or hydroxy-substituted aliphatic hydrocarbon group, $R_{2a}$ is $C_8$ to $C_{24}$, saturated or unsaturated, straight-chain or branched, aliphatic hydrocarbon group or hydroxy-substituted aliphatic hydrocarbon group, $R_{3a}$, $R_{4a}$ and $R_{6a}$ each is a $C_1$ to $C_3$ alkyl or hydroxyalkyl group or a group of the formula

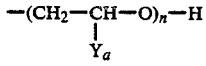

wherein n is an integer of 1 to 10 and $Y_a$ is hydrogen or methyl, $R_{5a}$ is a $C_{24}$ to $C_{36}$, saturated or unsaturated, branched aliphatic hydrocarbon group or hydroxy-substituted aliphatic hydrocarbon group, $R_{7a}$ and $R_{8a}$ each is a $C_7$ to $C_{21}$, saturated or unsaturated, straight-chain or branched, aliphatic hydrocarbon group or hydroxy-substituted aliphatic hydrocarbon group, A and B each is a $C_1$ to $C_3$ alkylene group, and $X_a$ is $CH_3SO_4$, $C_2H_5SO_4$, $C_nH_{2n+1}COO$ (wherein n is 0 to 17), $C_{n'}H_{2n'+1}OPO_3$ (wherein n' is 8 to 18), $HOCH_2COO$,

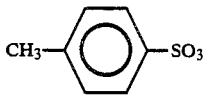

or halogen, (b) from 0.2 to 10 wt. % of a substance selected from the group consisting of (i) polyethers prepared by adducting ethylene oxide alone or both of ethylene oxide and propylene oxide to a compound having at least five active hydrogen atoms and which is selected from the group consisting of polyhydric alcohols, polyhydric phenols and polyamines, said polyether having a molecular weight of from 5,000 to 200,000 and containing at least 50 wt. % of ethylene oxide, based on the total weight of said polyether, (ii) sulfates, phosphates, alkylcarboxylates and fatty acid esters of the terminal hydroxy group of said polyethers, (iii) quaternary ammonium compounds of said polyethers that contain a nitrogen atom, with dialkylsulfates or alkyl halides, and (iv) salts of said polyethers with acetic acid or an alkylbenzene sulfonic acid.

4. A cloth-softening, liquid composition as claimed in claim 3 in which said compound having at least five active hydrogen atoms is selectd from the group consisting of sorbitol, sucrose, polyglycerin, polyvinyl alcohol, partially saponified polyvinyl acetate, phenol resin, alkylphenol-formaldehyde condensates, diethylenetriamine, triethylenetetramine, tetraethylenepentamine, pentaethylenehexamine and polyethyleneimine.

5. A cloth-softening, liquid composition as claimed in claim 3 in which the molecular weight of said polyether is from 10,000 to 100,000, and said polyether contains at least 80 wt. % of ethylene oxide, based on the total weight of said polyether.

6. A cloth-softening, liquid composition as claimed in claim 3 in which, in said fatty acid ester of said polyether, the fatty acid moiety has 7 to 23 carbon atoms.

7. A cloth-softening, liquid composition, comprising:

(a) from 7 to 30 wt. % of a quaternary ammonium salt component selected from the group consisting of compounds of the formulas

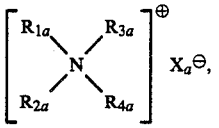

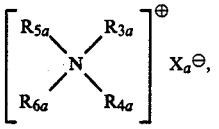

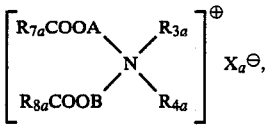

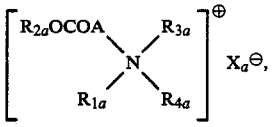

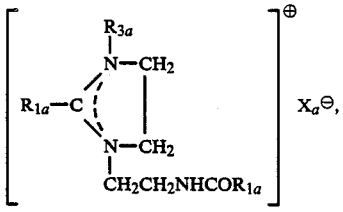

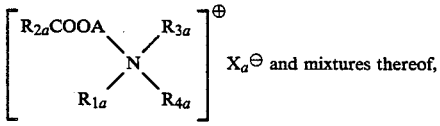

wherein $R_{1a}$ is $C_8$ to $C_{22}$, saturated or unsaturated, straight-chain or branched, aliphatic hydrocarbon group or hydroxy-substituted aliphatic hydrocarbon group, $R_{2a}$ is $C_8$ to $C_{24}$, saturated or unsaturated, straight-chain or branched, aliphatic hydrocarbon group or hydroxy-substituted aliphatic hydrocarbon group, $R_{3a}$, $R_{4a}$ and $R_{6a}$ each is a $C_1$ to $C_3$ alkyl or hydroxyalkyl group or a group of the formula $$-(CH_2-\underset{\underset{Y_a}{|}}{CH}-O)_n-H$$

wherein n is an integer of 1 to 10 and $Y_a$ is hydrogen or methyl, $R_{5a}$ is a $C_{24}$ to $C_{36}$, saturated or unsaturated, branched aliphatic hydrocarbon or hydroxy-substituted aliphatic hydrocarbon group, $R_{7a}$ and $R_{8a}$ each is a $C_7$ to $C_{21}$, saturated or unsaturated, straight-chain or branched, aliphatic hydrocarbon group or hydroxy-substituted aliphatic hydrocarbon group, A and B each is a $C_1$ to $C_3$ alkylene group, and $X_a$ is $CH_3SO_4$, $C_2H_5SO_4$, $C_nH_{2n+1}COO$ (wherein n is 0 to 17), $C_{n'}H_{2n'+1}OPO_3$ (wherein n' is 8 to 18), $HOCH_2COO$,

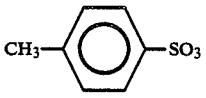

or halogen, (b) from 0.2 to 10 wt. % of a polymer of a cationic surfactant monomer having the formula

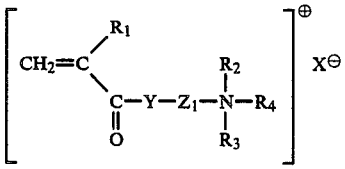

wherein $R_1$ is hydrogen or methyl; $R_2$ is a straight-chain or branched, alkyl or alkenyl having 8 to 24 carbon atoms or a substituted, straight-chain or branched, alkyl or alkenyl having 8 to 24 carbon atoms; $R_3$ and $R_4$ each is hydrogen, lower alkyl, $C_2$ to $C_4$ hydroxyalkyl or polyoxyalkylene ($\bar{P}=1$ to 3); Y is oxygen or —NH—; $Z_1$ is hydroxyalkylene having 2 to 4 carbon atoms and X is halogen or an acid residue, or a copolymer of said cationic surfactant monomer and at least one additional vinyl monomer, and the balance comprises water.

8. A cloth-softening, liquid composition as claimed in claim 7 in which said polymer is a copolymer of said cationic surfactant monomer and at least one additional vinyl monomer and said vinyl monomer is selected from the group consisting of alkyl (meth) acrylates having a $C_1$ to $C_{24}$ hydrocarbyl group, styrene, α-methylstyrene, acrylamide, methacrylamide, N-vinyl-2-pyrrolidone, 2-hydroxyethyl methacrylate, 2-hydroxyethylacrylate, polyethylene glycol monomethacrylate, methoxypolyethylene glycol methacrylate, and quaternary ammonium salts having the formula

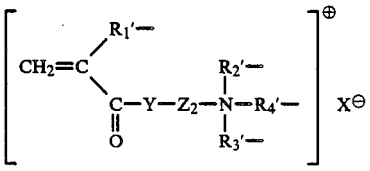

wherein $R_{1'}$ is hydrogen or methyl, $R_{2'}$, $R_{3'}$ and $R_{4'}$ is hydrogen, lower alkyl, $C_2$ to $C_4$ hydroxyalkyl or polyoxyalkylene ($\bar{P}$ is 1 to 3), Y is oxygen or —NH—, $Z_2$ is alkylene or hydroxy-alkylene having 2 to 4 carbon atoms and X is halogen or an acid residue.

9. A cloth-softening, liquid composition according to claim 8 in which said copolymer contains from 3 to 50% by weight of said cationic surfactant monomer.

* * * * *